United States Patent [19]

Heina et al.

[11] Patent Number: 4,643,412

[45] Date of Patent: Feb. 17, 1987

[54] DEVICE TO PICK UP SHEETS FROM A STACK AND TRANSPORT THE SHEETS AWAY FROM THE STACK

[75] Inventors: Karl-Fritz Heina, Murrhardt; Adolf Hornung, Reichenberg; Kurt Wörner, Backnang; Klaus Wolf, Oppenweiler, all of Fed. Rep. of Germany

[73] Assignee: Maschinenbau Oppenweiler Binder GmbH & Co., Fed. Rep. of Germany

[21] Appl. No.: 709,037

[22] Filed: Mar. 7, 1985

[30] Foreign Application Priority Data

Mar. 19, 1984 [DE] Fed. Rep. of Germany ..... 3410026

[51] Int. Cl.[4] ..... B65H 3/12

[52] U.S. Cl. ..... 271/94; 271/108; 271/34; 271/197

[58] Field of Search ..... 271/94, 95, 96, 98, 271/108, 112, 113, 34, 35, 276, 197

[56] References Cited

U.S. PATENT DOCUMENTS

| | | | |
|---|---|---|---|
| 3,389,908 | 6/1968 | Martin | 271/197 |
| 3,941,372 | 3/1976 | Matsuo | 271/96 X |
| 4,361,317 | 11/1982 | Lapp-Emden | 271/98 X |

FOREIGN PATENT DOCUMENTS

| | | |
|---|---|---|
| 1279396 | 10/1968 | Fed. Rep. of Germany . |
| 1756899 | 8/1970 | Fed. Rep. of Germany . |
| 1781421 | 5/1973 | Fed. Rep. of Germany . |
| 0010841 | 12/1955 | German Democratic Rep. . |

OTHER PUBLICATIONS

McCarty, V. D., "Sheet Material Transport System", IBM Technical Disclosure Bulletin, vol. 16, No. 12, May 1974, pp. 3902-3903.

*Primary Examiner*—Douglas C. Butler
*Assistant Examiner*—Lawrence J. Goffney, Jr.
*Attorney, Agent, or Firm*—John F. A. Earley; John F. A. Earley, III

[57] ABSTRACT

A guide block (11) has a groove (16) with a flat floor cut into it, in which an endless belt (15) containing perforations (17) travels. A suction opening (18) opens into the floor of the groove (16), to which a vacuum is periodically applied by means of a valve (12). The endless belt (15) travels over a stack (1) of sheets (2) by means of guide rollers (4,5) and a drive roller (3). The vacuum, when periodically applied by the valve (12), operates through the perforations (17) so that the topmost sheet (2) of the stack (1) is sucked against the endless belt (15) and carried away in the same direction (28). One preferred form of the endless belt (15) is a toothed belt, with spaces between the teeth (21) that form vacuum chambers (22). With this compact and therefore easily positionable device, sheets (2) are sucked up from a stack (1) and transported away while maintaining their orientation, meaning that very high production rates are attained.

5 Claims, 3 Drawing Figures

Figure 1:
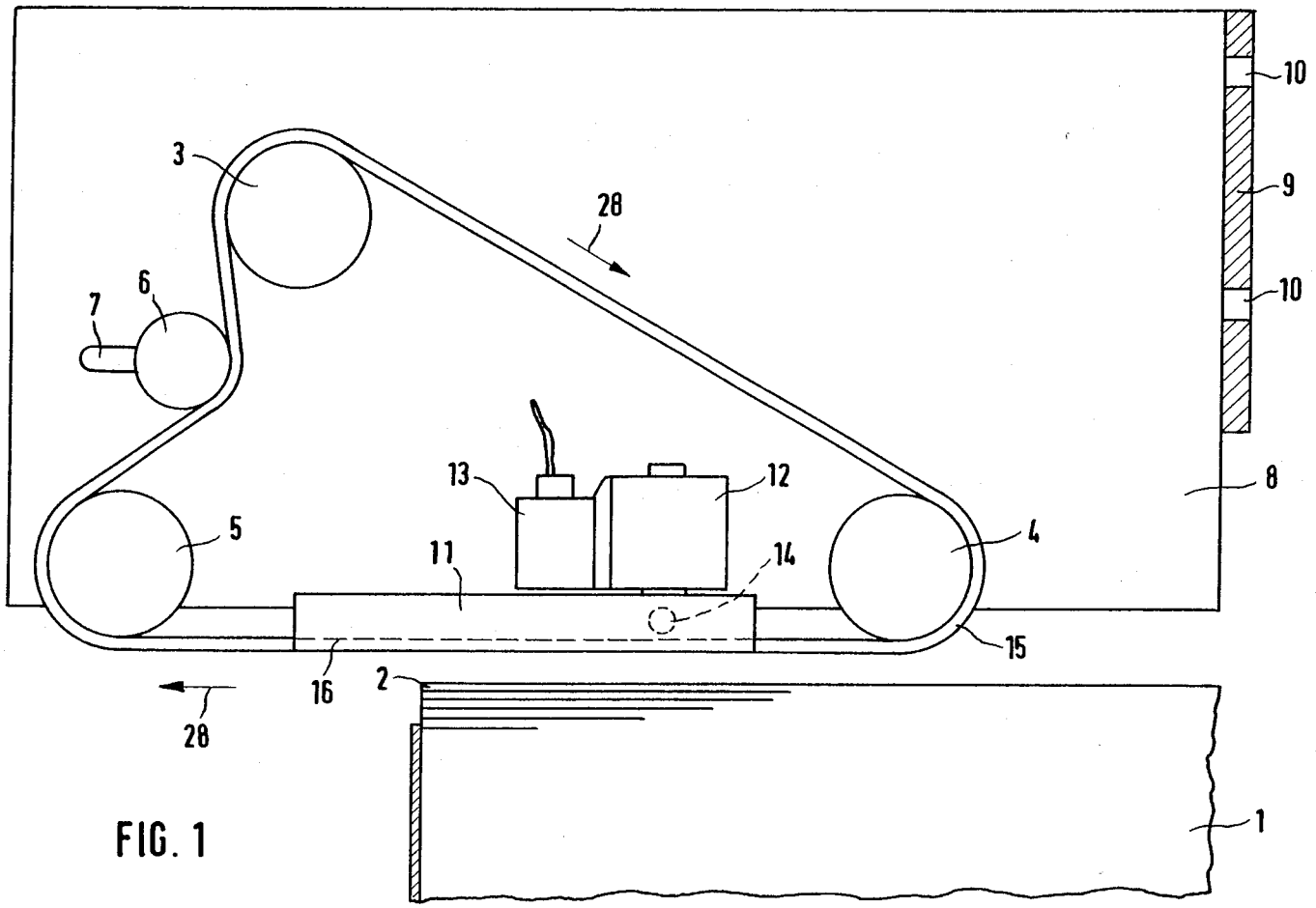

DEVICE TO PICK UP SHEETS FROM A STACK AND TRANSPORT THE SHEETS AWAY FROM THE STACK

The invention refers to a device for picking up sheets from a stack and transporting these sheets away from the stack by means of an endless moving belt, which is provided with a plurality of holes and which is equipped with a guide block, immobile with respect to the stack, on the guiding surface of which is a groove with a depth which corresponds substantially to the thickness of the belt and a width which corresponds substantially to the width of the belt, and which comprises a suction opening which can be connected to a vacuum source and is coordinated with the holes in the belt.

Such a device, known from No. DE-AS 12-79-396 in the Federal Republic of Germany, published Oct. 3, 1968, which is incorporated herein by reference, is used for the selective removal of sheets of paper in two directions, by means of two parallel flat endless vacuum belts, which are driven with guide rollers and are equipped with perforations. These perforations are coordinated with the vacuum openings in a guide block, which by insertion of a valve can be connected to a suction chamber which in turn can be attached to a vacuum source. In addition, the suction belts run in recesses in the guide block, so that the belts are flush with the outer surface of the guide block facing the paper.

In this arrangement of the device, the suction effect above the suction surface, i.e. in the direction of belt travel, and also diagonal to it, is not precisely definable in terms of thickness, so that considerable oversizing of the suction vacuum is necessary to guarantee the desired suction effect.

The basic purpose of the invention is therefore to arrange the device initially mentioned in such a way that by the application of a weak vacuum, a large suction power and force can be produced in a predetermined distribution and dynamics over the surface area.

This purpose is performed by the device initially mentioned by having the endless belt be a toothed belt, the teeth of which turned toward the stack are defined by side walls of a groove forming cavities, which belt comprises at least one hole between each two teeth. A cutout is provided which extends in the guide block in the direction of sheet travel and is connected to the suction opening and coordinated with the holes.

With the device according to the invention, it is possible to use a low vacuum of e.g. 0.3 bar, such as can be produced by a side-channel compressor, but nonetheless, because of the large suction surface, to obtain a high suction power, which is applied by the vacuum within the chambers between the teeth on the toothed belt and the side walls of the groove 16. This also produces a high degree of dynamics because the valve is placed directly on the guide block together with the suction opening, and the volume to be evacuated is therefore small, and also because the vacuum forms primarily in the suction chambers over the suction opening, to which they are directly connected through the valve. At the same time the effective range over which there occurs a great distant effect with the aspiration of the sheets to be sucked away from the stack, since the flow velocity of the aspirated air is exceptionally high due to the initially small cross-section. Because of the initially high flow resistance, the vacuum in the cutout connected to the suction openings and over the corresponding holes in the corresponding suction chambers between the teeth of the belt builds up but later, thus ensuring safe removal of the sheet.

The suction zone can also be adjusted due to the fact that the side walls 25 of the groove 16 end some distance away from the side of the guide block where the belt runs off so that the lateral guides for the toothed belt, and, therefore, also the lateral limits of the suction zone, are eliminated ahead of the end or front wall 27 of the guide block 11.

If the guide block 11 is adjustable along the direction 28 of paper travel with respect to the stack 1, without changing the spatial association of the stack-holding apparatus and of the apparatus receiving the sheets 2 removed by the device, usually an alignment table, it is possible to regulate the distance traveled by the sheets 2 along the sheet-receiving apparatus.

The device according to the invention can also be used for the removal of sheets from the underside of a stack. It is thus possible to transport folded sheets at a right angle away from a folding machine, store them in a buffer stack, and continuously remove them from that stack for further processing. This makes it possible, even in cases where sheets must turn through a right angle, to achieve very high overall sheet transport rates through a system.

The device as described according to the invention makes possible a considerable increase in the number of sheets transported per hour (on the order of magnitude of 60,000), since valve switching times can be kept very short.

In addition, the aspiration of air through the toothed belt against the guiding surface of the guide block means that an air cushion is established between the surface of the toothed belt on the side of the guiding surface and the guide surface itself, so that direct contact between the toothed belt and the guiding surface does not occur and the toothed belt travels over the guiding surface with little friction.

Figure 2:
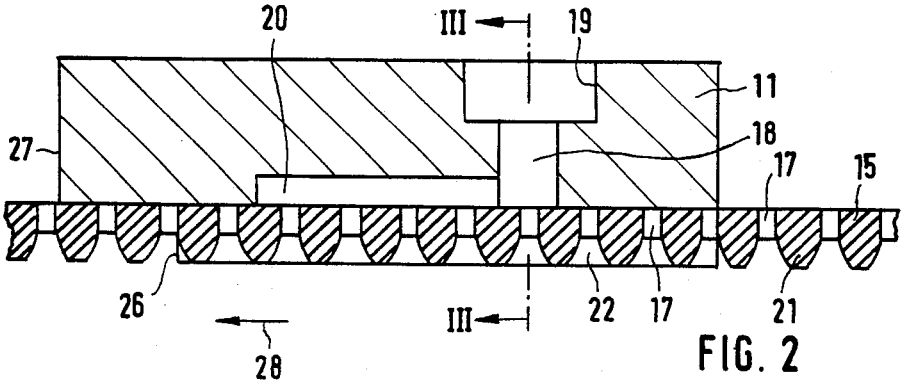
Figure 3:
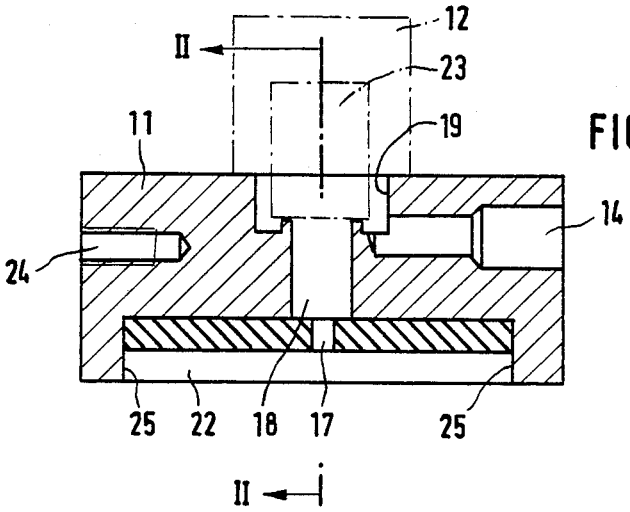

Some embodiments of implementation of the invention will be explained in more detail with reference to the drawings. These show:

FIG. 1: a schematic side view of one implementation of the device;

FIG. 2: the guide block with toothed belts, along section 11—11 of FIG. 3;

FIG. 3: section 111—111 of FIG. 2.

The device shown in FIG. 1 is installed over a stack of sheets 1, of which the topmost sheet 2 must be picked up and transported away. The device consists of a drive roller 3 and two guide rollers 4 and 5 as well as a tension roller 6, over which an endless belt in the form of a toothed belt 15 travels. The rollers are placed on a plate 8 on which is mounted a reinforcement flange 9, which can be attached by means of bores 10 to part of a machine (not shown). The tension roller 6 is adjustable along a slot 7 in the plate 8. The device is positioned so that the toothed belt 15 runs between the guide rollers 4 and 5 generally parallel to and above the stack 1.

In addition, the toothed belt 15 is guided under the flat guiding surface of a guide block 11, which guiding surface consists of the bottom of a groove 16 in the guide block 11 on the side towards the stack 1. The guide block 11 consists of a feed portion stretching over the stack 1 and a runoff portion projecting away from the stack 1, as illustrated by the arrows 28 showing the direction of motion of the toothed belt 15.

As shown in FIGS. 2 and 3, the toothed belt has regularly spaced teeth 21, which form chambers 22 between them into which a hole 17 provided between two teeth 21 opens. The chambers 22 are laterally bounded by side walls 25 of the groove 16. A suction opening 18, which continues into a bore 19, opens into the bottom of the groove 16.

In the bore 19, as shown in FIG. 1, is a valve 12, which is connected through a vacuum opening 14 to a vacuum source (not shown), for example a side-channel compressor, and which has an electrically operated control mechanism 13. The valve 12 with the control mechanism 13 is made in a known fashion. FIG. 3 is a schematic illustration of the valve 12 and its valve piston 23. The vacuum acts clock-controlled or periodically, through the valve 12 and the bore 19, on the suction opening 18 and the holes 17 in the toothed belt 15 which are in contact with it, through which air is aspirated to form a cushion between the bottom of the groove 16 and the toothed belt 15 so that the latter can travel without friction; simultaneously, the topmost sheet 2 of the stack 1 (FIG. 1) is aspirated by the vacuum and carried away by the toothed belt 15 in the direction of the arrow 28.

The suction opening 18 has a cutout 20 extending in the direction of sheet removal (shown by arrow 28), which also opens into the bottom of the groove and extends over the holes 17. The vacuum applied through the suction opening 18 is also effective in the cutout 20, although it becomes weaker along the direction of sheet removal. As shown by FIG. 2, the front edge 26 (in the direction of sheet removal) of the side walls 25 of the groove 16 does not reach as far as the front wall 27 (in the direction of sheet removal) of the guide block 11, so that the vacuum effect ceases beyond the front edge 26 of the side walls 25 of the groove 16.

The guide block 11 can be attached to the plate 8 (FIG. 1) with bolts (not shown) which are threaded into bores 24 (FIG. 3) in the guide block 11.

We claim:

1. Device for taking off sheets from a stack of sheets and for transporting said sheets away from the stack comprising a toothed belt (15) continuously running in a running direction (28) over at least one drive roller (3), at least two guide rolls (4,5) and at least one tension roll (6), said toothed belt (15) having spaced apart teeth (21), a valve (12) connected to a vacuum source, a guide block (11) mounted in two sections between said two guide rolls (4,5), extending with one section on an entry side of the toothed belt above the stack of sheets (1) and with the other section on an exit side of the toothed belt beyond the stack of sheets, and terminating at a front wall (27) on said exit side, a groove (16) formed in the guide block (11) facing the stack of sheets (1), the bottom of the groove (16) extending substantially parallel with respect to the stack of sheets (1), the depth of the groove (16) corresponding to the height of the toothed belt (15), the groove (16) having side walls (25) between which the toothed belt (15) is movable free of friction, the chambers (22) being formed between each of the teeth (21) of the toothed belt (15) and the side walls (25), each chamber (22) being closed at the side walls (25), at least one hole (17) opening into each chamber (22) of the toothed belt (15), a suction port (18) being provided in the guide block (11) in alignment with respect to the holes (17), which suction port (18) is connectable to the vacuum source by the piston (23) of the valve (12) in a clock-controlled manner, and a recess (20) provided in the guide block (11) adjacent to the suction port (18) in the transport direction of the sheets, said recess (20) being arranged in alignment with respect to the holes (17) in the toothed belt (15).

2. The device of claim 1, the side walls (25) of the groove (16) end being at a distance short of the front wall (27) of the guide block (11).

3. The device of claim 1, the guide block (11) being adjustable in the running direction (28) of the toothed belt (15) with respect to the stack of sheets (1).

4. The device of claim 1, the top of the stack of sheets being associated with said device for conveying the sheets off.

5. Device for taking off sheets from a stack of sheets and for transporting said sheets away from the stack comprising a toothed belt (15) continuously running in a running direction (28) over at least one drive roller (3), at least two guide rolls (4,5) and at least one tension roll (6), said toothed belt (15) having spaced apart teeth (21), a valve (12) connected to a vacuum source, a guide block (11) mounted in two sections between said two guide rolls (4,5), extending with one section on an entry side of the toothed belt above the stack of sheets (1) and with the other section on a exit side of the toothed belt beyond the stack of sheets, and terminating at a front wall (27) on said exit side, a groove (16) formed in the guide block (11) facing the stack of sheets (1), the bottom of the groove (16) extending substantially parallel with respect to the stack of sheets (1), the depth of the groove (16) corresponding to the height of the toothed belt (15), the groove (16) having side walls (25) between which the toothed belt (15) is movable free of friction, the chambers (22) being formed between each of the teeth (21) of the toothed belt (15) and the side walls (25), each chamber (22) being closed at the side walls (25), at least one hole (17) opening into each chamber (22) of the toothed belt (15), a suction port (18) being provided in the guide block (11) in alignment with respect to the holes (17), which suction port (18) is connectable to the vacuum source by the piston (23) of the valve (12) in a clock-controlled manner, and a recess (20) provided in the guide block (11) adjacent to the suction port (18) in the transport direction of the sheets, said recess (20) being arranged in alignment with respect to the holes (17) in the toothed belt (15), the side walls (25) of the groove (16) end being at a distance short of the front wall (27) of the guide block (11), the guide block (11) being adjustable in the running direction (28) of the toothed belt (15) with respect to the stack of sheets (1), the top of the stack of sheets being associated with said device for conveying the sheets off.

* * * * *